US008353132B1

(12) United States Patent
Vogt et al.

(10) Patent No.: US 8,353,132 B1
(45) Date of Patent: Jan. 15, 2013

(54) METHOD AND APPARATUS FOR ERECTION AND DISASSEMBLY OF A SECTIONAL MAST ASSEMBLY

(75) Inventors: Dewayne G. Vogt, Tulsa, OK (US); Paul Landis, Tulsa, OK (US)

(73) Assignee: Woolslayer Companies, Inc., Tulsa, OK (US)

( * ) Notice: Subject to any disclaimer, the term of this patent is extended or adjusted under 35 U.S.C. 154(b) by 28 days.

(21) Appl. No.: 13/028,590

(22) Filed: Feb. 16, 2011

Related U.S. Application Data

(60) Provisional application No. 61/329,869, filed on Apr. 30, 2010.

(51) Int. Cl.
*E04H 12/34* (2006.01)

(52) U.S. Cl. ..... 52/123.1; 52/745.17; 52/651.01; 52/651.07

(58) Field of Classification Search ..... 52/745.18, 52/745.17, 123.1, 111, 651.01, 651.07
See application file for complete search history.

(56) References Cited

U.S. PATENT DOCUMENTS

| | | | | |
|---|---|---|---|---|
| 1,561,724 | A | 11/1925 | Keltner | |
| 2,354,922 | A | 8/1944 | McEwen et al. | |
| 2,711,804 | A | 6/1955 | Woolslayer et al. | |
| 3,483,933 | A | 12/1969 | Dyer et al. | |
| 3,498,375 | A | 3/1970 | McEwen et al. | |
| 3,718,266 | A | 2/1973 | Donnally | |
| 3,942,593 | A | 3/1976 | Reeve et al. | |
| 4,587,778 | A * | 5/1986 | Woolslayer et al. | 52/116 |
| 4,651,884 | A | 3/1987 | Kennard, Jr. et al. | |
| 4,920,710 | A * | 5/1990 | Paine | 52/108 |
| 4,932,175 | A * | 6/1990 | Donnally | 52/118 |
| 5,038,871 | A | 8/1991 | Dinsdale | |
| 5,211,251 | A | 5/1993 | Woolslayer | |
| 5,450,695 | A * | 9/1995 | Desai | 52/118 |
| 6,430,887 | B1 | 8/2002 | Daudet | |
| 6,594,960 | B2 * | 7/2003 | Brittain et al. | 52/117 |
| 2011/0072737 | A1 * | 3/2011 | Wasterval | 52/115 |

FOREIGN PATENT DOCUMENTS

| | | |
|---|---|---|
| GB | 717099 | 10/1954 |

* cited by examiner

*Primary Examiner* — Jeanette E Chapman
*Assistant Examiner* — James Buckle, Jr.
(74) *Attorney, Agent, or Firm* — Head Johnson & Kachigian PC

(57) ABSTRACT

A method and an apparatus for a sectional mast assembly for erection and disassembly of a rig. The sectional mast assembly includes a bottom section having at least a back and a pair of opposed sides with each of the opposed sides having at least one pivoting ratchet support. A scoping dog assembly is moveable on a track on the bottom section. The scoping clog assembly includes wheels which engage the track and a pivoting ratchet support. A cylinder extends between the bottom section and the scoping dog assembly to move the scoping dog assembly on the track. The pivoting ratchet support of the scoping dog assembly engages each of the mast sections in sequence to raise the entire mast assembly.

5 Claims, 24 Drawing Sheets

METHOD AND APPARATUS FOR ERECTION AND DISASSEMBLY OF A SECTIONAL MAST ASSEMBLY

CROSS-REFERENCE TO RELATED APPLICATION

This application claims priority to U.S. Provisional Application No. 61/329,869, filed Apr. 30, 2010.

BACKGROUND OF THE INVENTION

1. Field of the Invention

The present invention is directed to an apparatus and to a method for erection and disassembly of a sectional mast assembly. In particular, the present invention is directed to an apparatus and method wherein sections or segments of a mast assembly are sequentially inserted, raised, and installed.

2. Prior Art

A mast or a derrick of a rig, such as a subterranean drilling rig, supports a block and tackle to raise and lower drill hits, drill pipes and other equipment. Drilling rigs can be used for mineral exploration drilling, water well drilling, oil well drilling, and natural gas drilling. When in operation, a mast will often extend up to 200 feet from the ground. Once a drilling project has been completed, the drilling rig is disassembled, transported to the next location, and then reassembled for use. Accordingly, the ability to quickly and efficiently erect and then disassemble a drilling rig is of paramount importance.

Assignee's U.S. Pat. No. 6,594,960 entitled "Method of Folding an Articulating Mast" shows an example of raising or lowering of a mast utilizing a folding gin pole and drawworks.

In some use applications, the space on or adjacent to the rig is at a premium, such as in mountainous locations or off-shore on a marine platform.

In these cases, it would advantageous to be able to install and assemble the drilling mast in sections or segments and to disassemble the mast in sections or segments.

The present invention provides an apparatus and a method for erection and disassembly of a sectional mast assembly which requires minimum equipment sizes, minimum platform area and minimum transport loads.

The present invention also provides an apparatus and a method for erection and disassembly of a sectional mast assembly which minimizes required personnel for erection and disassembly of the sectional mast assembly.

The present invention also provides an apparatus and a method for erection and disassembly of a sectional mast assembly which utilizes power systems existing on a drilling rig.

SUMMARY OF THE INVENTION

The present invention is directed to the method and apparatus for erection and disassembly of a sectional mast assembly. In a preferred embodiment, a bottom section may be mounted on a platform, subbase or other equipment. The bottom section includes a back and a pair of opposed sides with an open face. Where the opposed sides meet the back, a pair of guide channels are formed. A number of discrete sections or segments are employed such as a lower mast section which is connected to and extends from the bottom section. A lower mid-mast section is connected to the lower mast section and extends therefrom.

The bottom section includes a track which is substantially parallel to a center line of the well. The track may be composed of a pair of tubes having a square or rectangular cross section with a space there between. A scoping dog assembly travels and is movable on the track.

An extension and retraction mechanism is employed in order to move and reciprocate the scoping dog assembly on the track. In one preferred embodiment, a cylinder extends between the bottom section and the scoping dog assembly.

Each of the opposed sides of the bottom section includes a pair of pivoting ratchet supports which extend into the interior of the bottom section. When in the normal at rest position, each ratchet support prevents downward movement of a mast section within the bottom section. Each ratchet support may be pivoted or rotated out of the way.

Additionally, each opposed side of the bottom section includes at least one permanent retention pin which is inserted through the side following completion of the assembly to retain the mast sections in place.

At the intersection of the back section and the sides are located guide channels. The guide channels sequentially receive the mast sections as they enter and move through the bottom section. Each of the individual mast sections has an external cross section dimension slightly smaller than the open interior dimension of the bottom section.

With one of the mast sections within the bottom section, the method or process of sequential installation and erection may be performed. Any retention pins are removed and withdrawn so that the section within the bottom section is supported by the ratchet support of the scoping dog assembly. The scoping dog assembly may be lowered on the track so that the base of the installed section will be aligned with another section in a horizontal position. When the openings are aligned, pins or other fasteners are inserted therethrough and secured.

Thereafter, action of the scoping dog assembly moving upward by extension action of the hydraulic cylinder causes the mast section within the bottom section to move upward which also causes the top of the horizontal section to move upward and also rotate 90 degrees from a horizontal to a vertical position. Once both sections are fully aligned in the vertical position, the remaining pins secure the two mast sections together.

The installation sequence will continue in a similar manner for each additional mast section. In order to disassemble the sectional mast assembly, the opposite procedure is performed.

BRIEF DESCRIPTION OF THE DRAWINGS

FIGS. 7 through 14 illustrate side views while

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
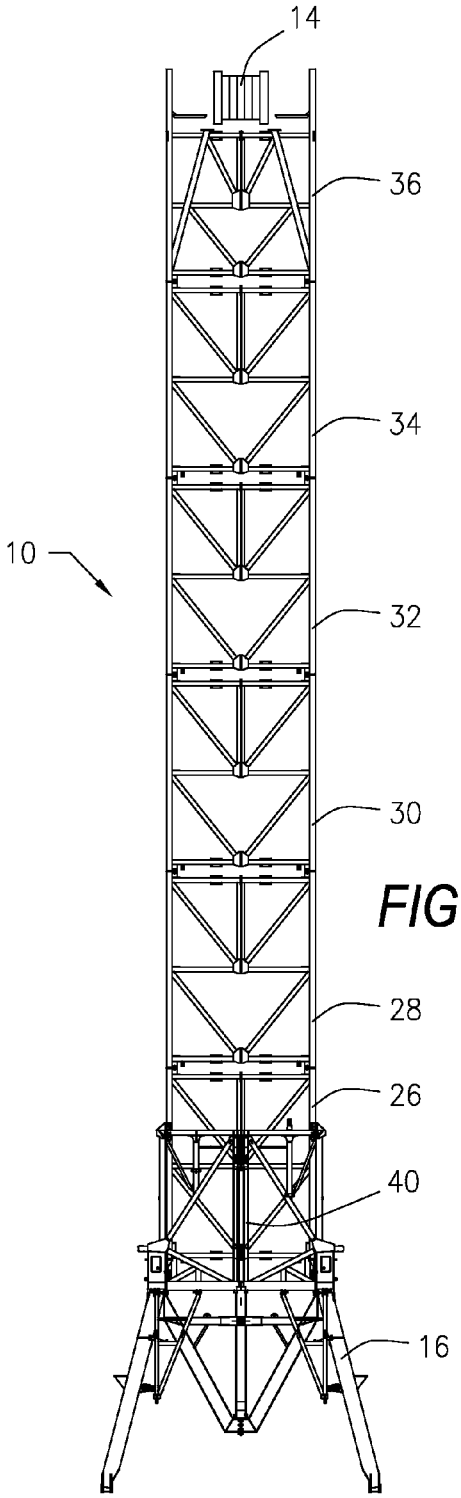
FIG. 1 illustrates a back or rear view and FIG. 2 illustrates a side view of a sectional mast assembly in fully erected form constructed in accordance with the present invention.
Figure 2:
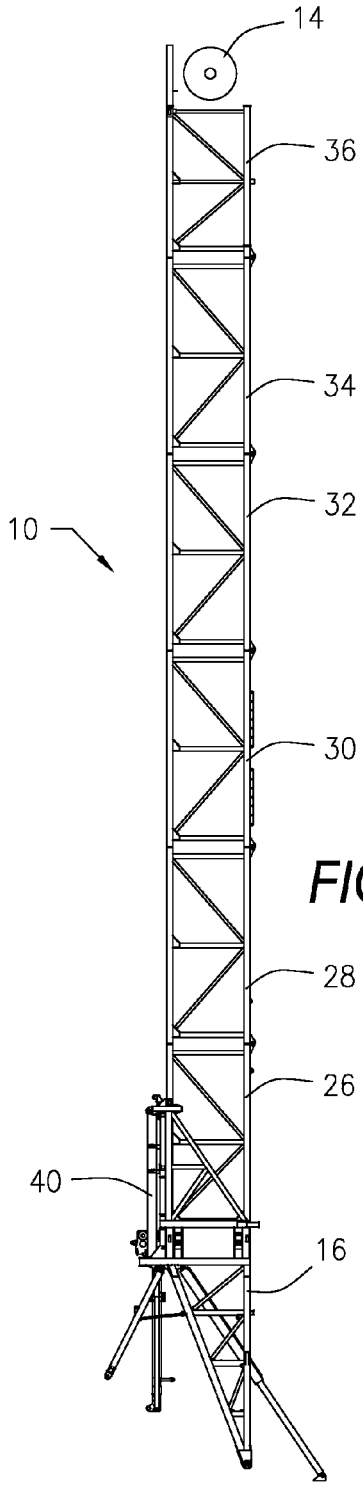

Referring to the drawings in detail, FIG. 1 illustrates a back view and FIG. 2 illustrates a side view of a sectional mast assembly 10 for a drilling rig, which is constructed in accordance with the present invention. It will be appreciated that the sectional mast assembly of the present invention may be used for various types of rigs. The sectional mast assembly 10 is shown fully assembled for use in FIGS. 1 and 2 following erection. When in position for use, the sectional mast assembly 10 will be aligned substantially vertically to the ground (not shown) over a well center line (not shown).

The drilling rig may include a variety of other components and equipment, all of which are generally known in the industry. These may include a crown assembly 14 at the top of the sectional mast assembly 10, a drill floor, various wire lines, a racking platform for tubular segments, a traveling block and top drive, and a drawworks.

The sectional mast assembly 10 includes a number of discreet sections or segments. In one preferred embodiment shown herein, the sectional mast assembly 10 includes a bottom section 16 which, in turn, may be mounted on a platform (not shown), a subbase (not shown) or other equipment.

Figure 3:
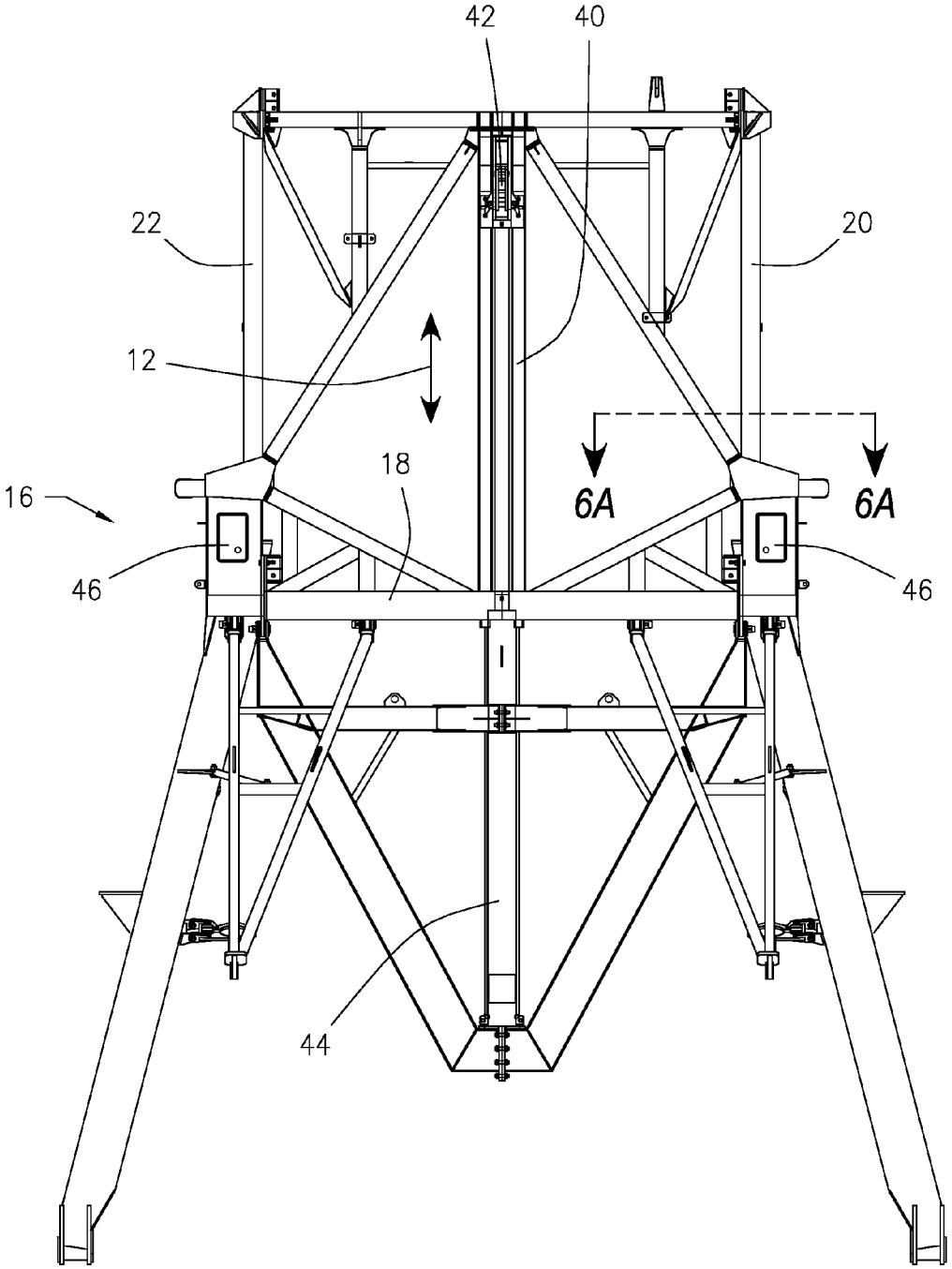
FIG. 3 illustrates a bottom section apart from the balance of the sectional mast assembly shown in FIGS. 1 and 2.

The bottom section 16 is shown in FIG. 3 apart from the balance of the mast sectional assembly 10 of the invention. The bottom section 16 includes a back 18 and a pair of opposed sides 20 and 22. In the preferred embodiment shown, the bottom section 16 has an open face although other configurations are possible within the spirit and scope of the invention. Where the opposed sides 20 and 22 meet the back 18 of the bottom section 16, a pair of guide channels are formed which provide a guide or restraint for movement of the remaining mast sections during erection and disassembly as will be described in detail herein. During erection of the mast assembly 10, the bottom section 16 will be installed first.

Returning to a consideration of FIGS. 1 and 2, the sectional mast assembly 10 also includes a number of discreet sections or segments. A lower mast section 26 is connected to and extends from the bottom section 16. A lower mid mast section 28 is connected to the lower mast section 26 and extends therefrom. A mid mast section 30 is connected to the lower mid mast section 28 and extends therefrom. An upper mid mast section 32 is connected to the mid mast section 30 and extends therefrom. A mast upper section 34 is connected to the upper mid mast section 32 and extends therefrom. Finally, a crown section 36 is connected to the mast upper section 34 and extends therefrom. Each of the mast sections may be fabricated from structural steel beams or other rigid material.

It will be appreciated that a greater or lesser number of mast sections may be employed.

Returning to a consideration of FIG. 3, the bottom section 16 includes a track 40 which is substantially parallel to a center line of the well (not shown). The track 40 may be mounted on the back 18 of the bottom section 16. The track 40 may be composed of pair of tubes having a square or rectangular cross-section with a space therebetween.

As will be explained in detail herein, a scoping dog assembly 42 travels and is moveable on the track 40. In one non-limiting example, the scoping dog assembly reciprocates from between 12 to 14 feet although other configurations are possible.

An extension and retraction mechanism is employed to move and reciprocate the scoping dog assembly 42. A cylinder 44 extends between the bottom section 16 and the scoping dog assembly 42. In a preferred embodiment, an hydraulic cylinder 44 powered by the existing rig hydraulic system is utilized although a pneumatic cylinder, a wireline and winch, or other types of extension and retraction mechanisms may be employed. Extension of the hydraulic cylinder 44 moves the scoping dog assembly 42 upward on the track 40 while the retraction of the hydraulic cylinder 44 moves the scoping dog assembly 42 downward on the track 40 as shown by arrow 12.

Figure 5:
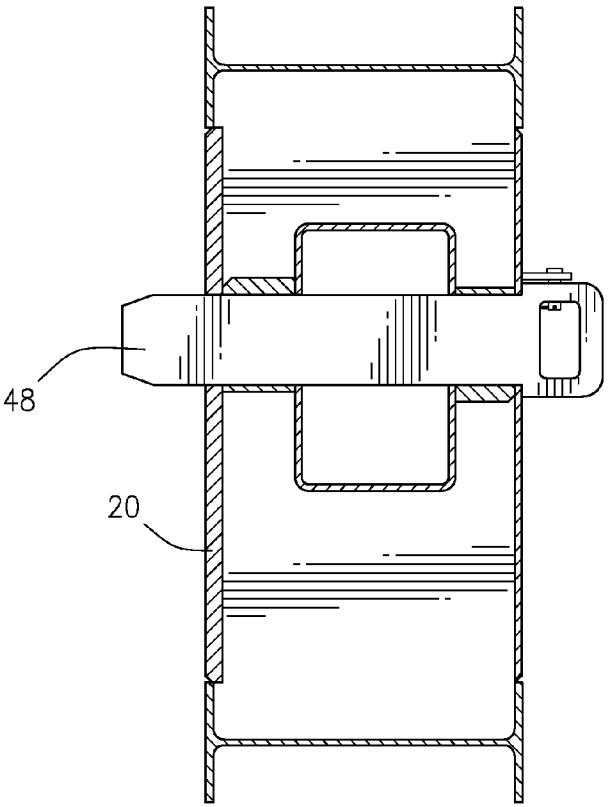
FIG. 4 illustrates a pivoting ratchet support of the sectional mast assembly of the present invention and FIG. 5 illustrates a permanent retention pin of the sectional mast assembly of the present invention.
Figure 4:
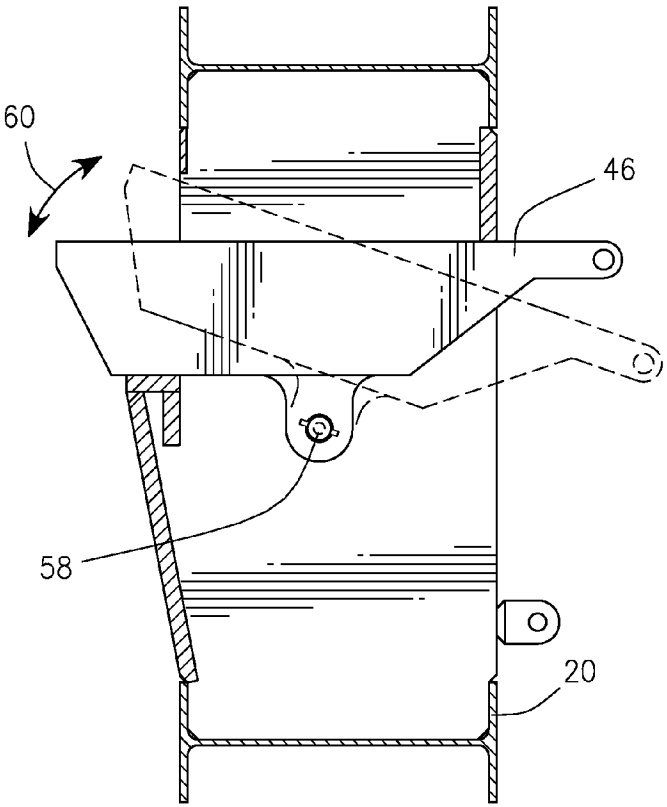
Figure 7:
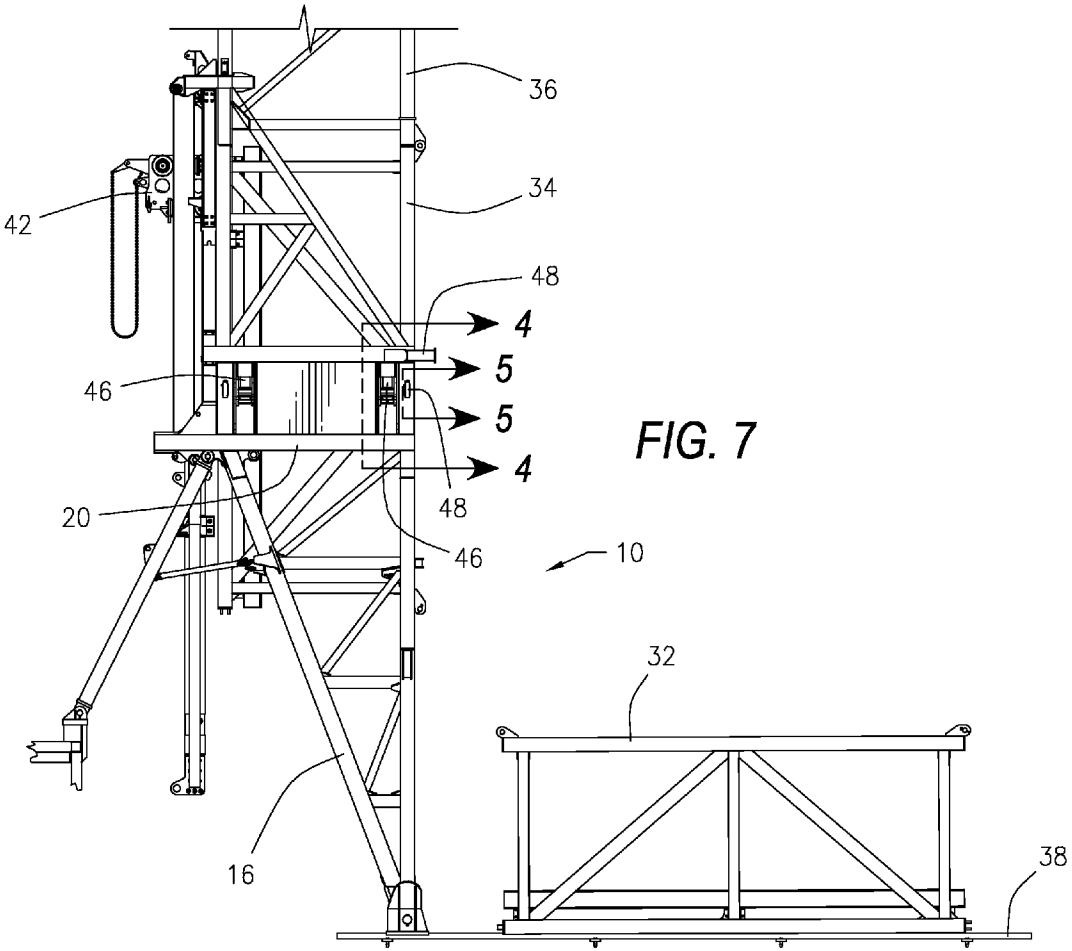

FIG. 4 illustrates a sectional view taken along section line 4-4 of FIG. 7. FIG. 5 illustrates a sectional view taken along section line 5-5 of FIG. 7. Referring to FIGS. 4 and 5 and with continuing reference to FIG. 3, each of the opposed sides 20 and 22 of the bottom section 16 includes a pair of pivoting ratchet supports 46 which extend into the interior of the bottom section 16. Accordingly four ratchet supports are provided. Each ratchet support 46 pivots about an axis pin 58.

FIG. 4 illustrates a view of the ratchet support 46 taken along section line 4-4 of FIG. 7. The ratchet support 46 is shown in the normal at rest position in FIG. 4. When in the normal at rest position, the ratchet support 46 prevents downward movement of a mast section. Each ratchet support 46 may be rotated or pivoted out of the way as shown by dashed lines for passage of one of the mast sections as will be described in detail. The ratchet support 46 moves as shown by arrow 60.

Additionally, as seen in FIG. 5, each opposed side 20 and 22 of the bottom section 16 includes at least one Permanent retention pin 48 which is inserted through the side 20 and 22 following completion of the assembly to retain the mast sections in place. When inserted, each retention pin 48 extends into the interior of the bottom section 16 in order to engage any mast section therein.

At the intersection of the back section 18 and the side 20 and at the intersection of the hack section 18 and the side 22, guide channels 50 are located. FIG. 6A illustrates a sectional view taken along sectional line 6-6 of FIG. 3 showing a guide channel 50 of the bottom section 16.

Figure 6B:
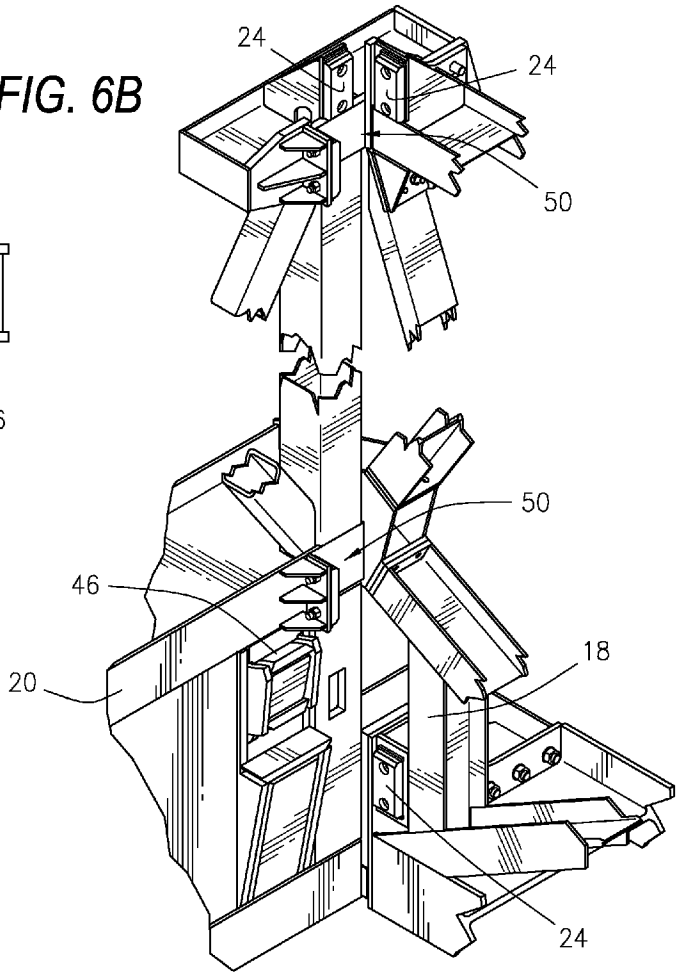
FIG. 6B illustrates an isometric view of a portion of the bottom section showing upper and lower channel guides.
Figure 6A:
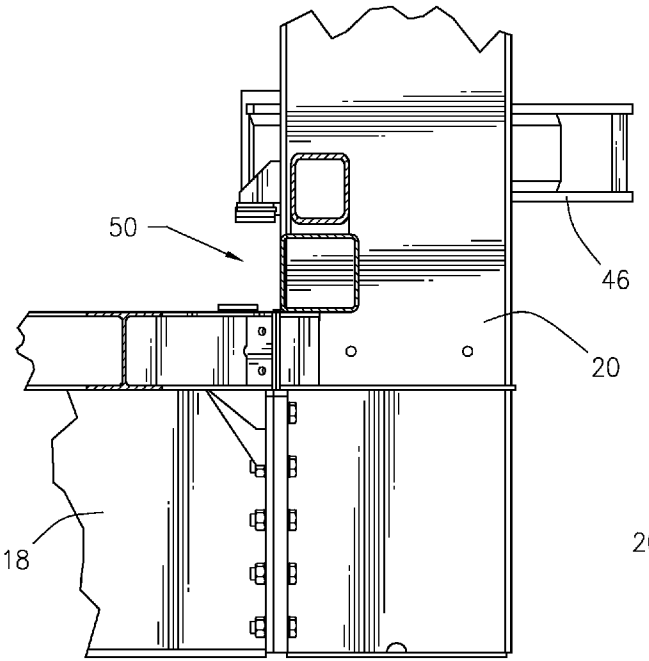
FIG. 6A illustrates a sectional view taken along section line 6-6 of FIG. 3 showing a channel guide in the bottom section of the sectional mast assembly.

FIG. 6B illustrates an isometric view of a portion of the bottom section 16 area showing upper and lower aligned guide channels 50. As will be described herein, the guide channels 50 sequentially receive mast sections as they enter and move therethrough. A plurality of guide pads 24 facilitate movement of the mast sections.

FIGS. 7 through 14 illustrate a side view and FIGS. 15 through 24 illustrate a rear perspective view of the method or process of sequential installation and erection of mast sections for assembly of a rig in accordance with the invention.

In the present embodiment, each of the individual mast sections 26, 28, 30, 32, 34, and 36 has similar cross-sectional dimensions. Each of the individual mast sections has an external cross-section dimension slightly smaller than the open interior dimensions of the bottom section 16. Accordingly, each of the individual mast sections will sequentially fit within the bottom section 16.

Figure 8:
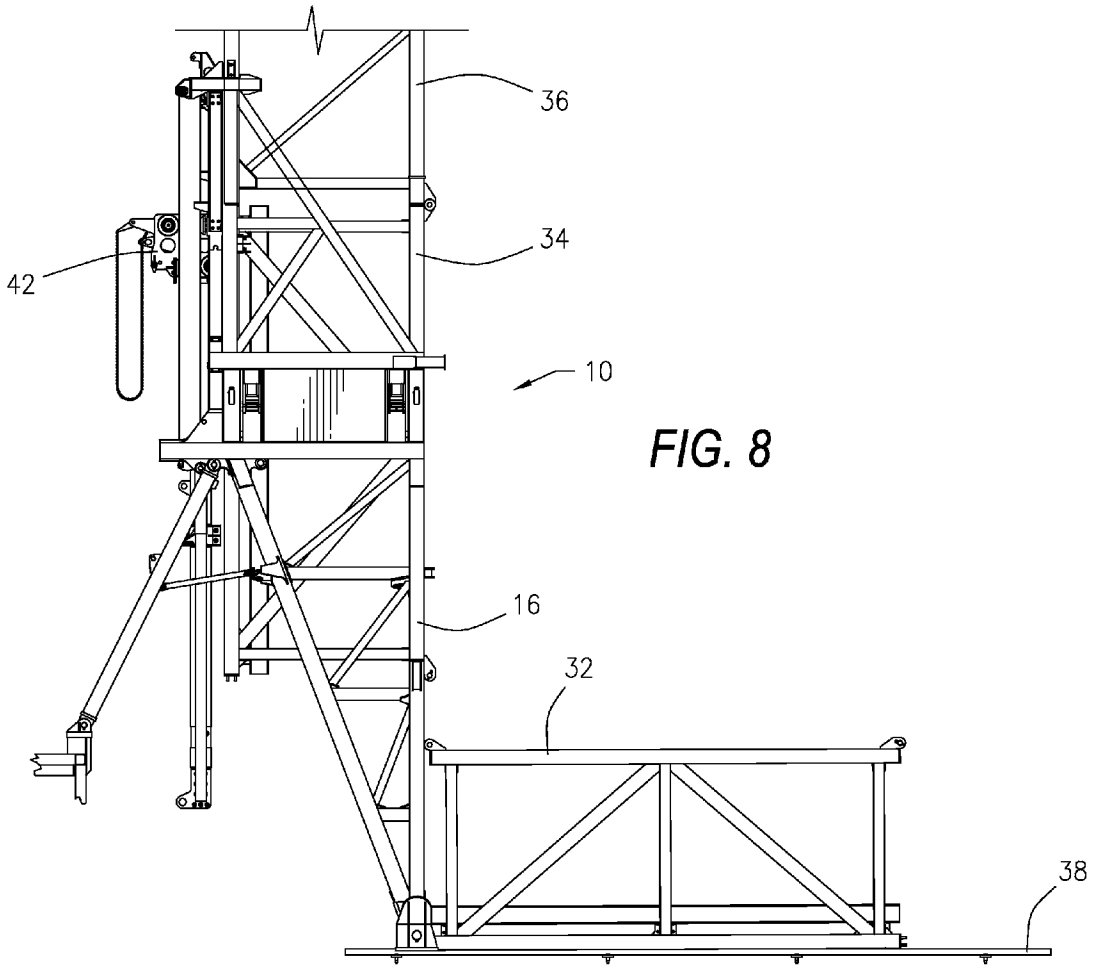
Figure 9:
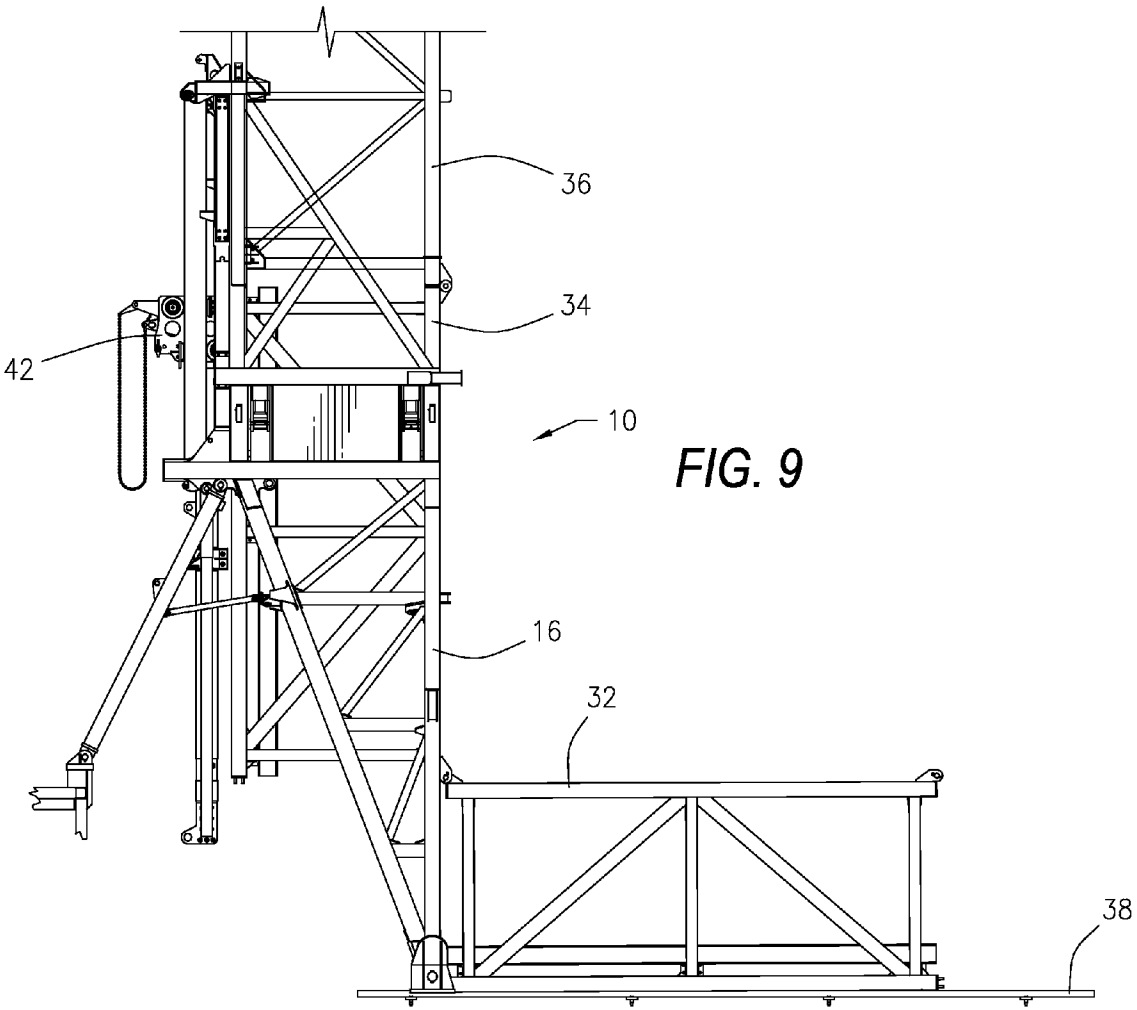
Figure 10:
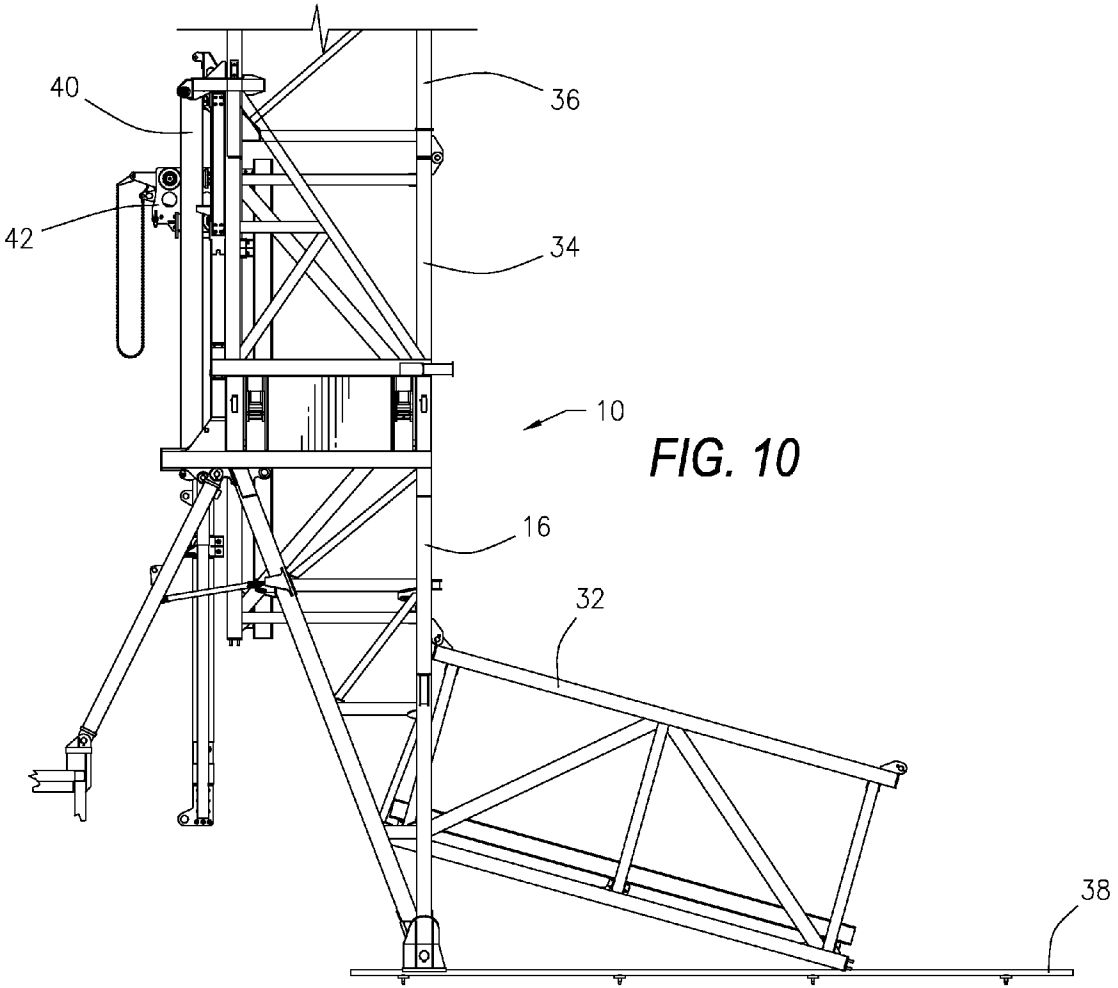
Figure 11:
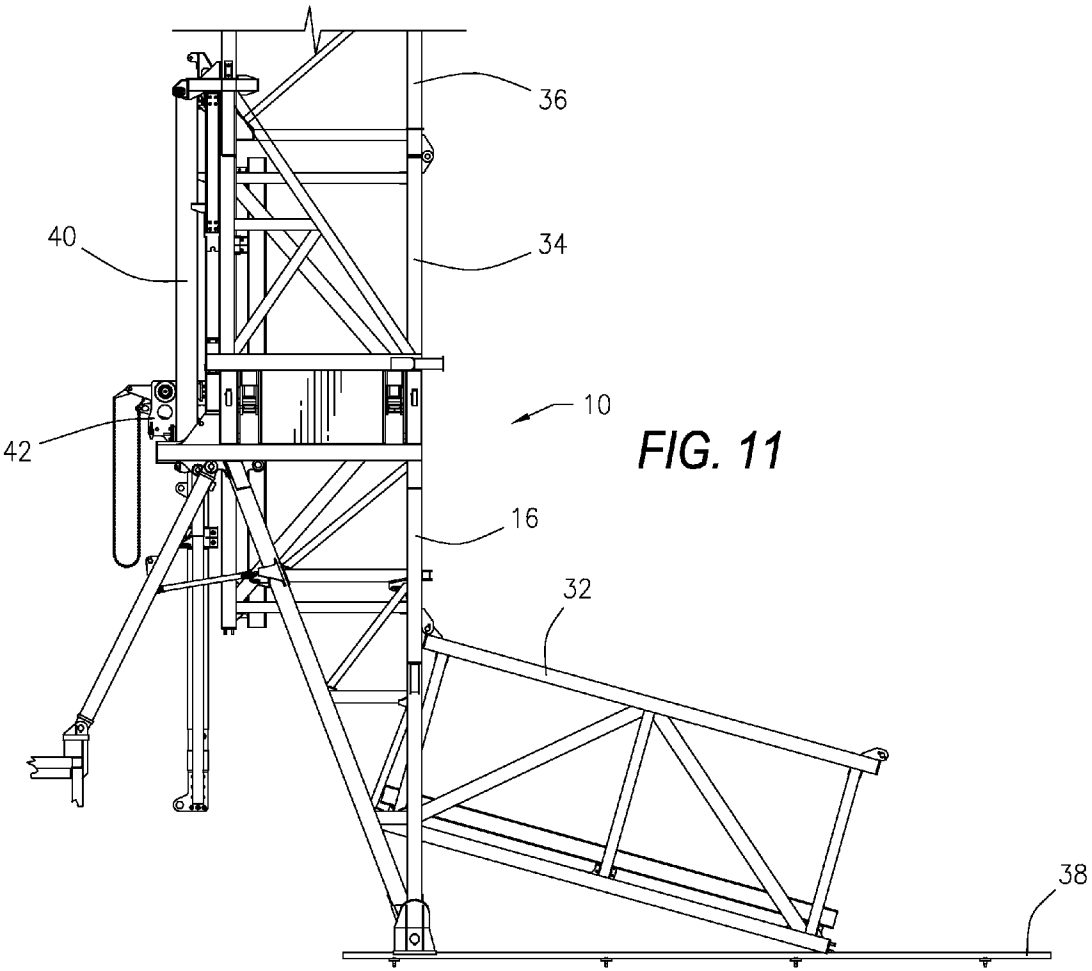
Figure 12:
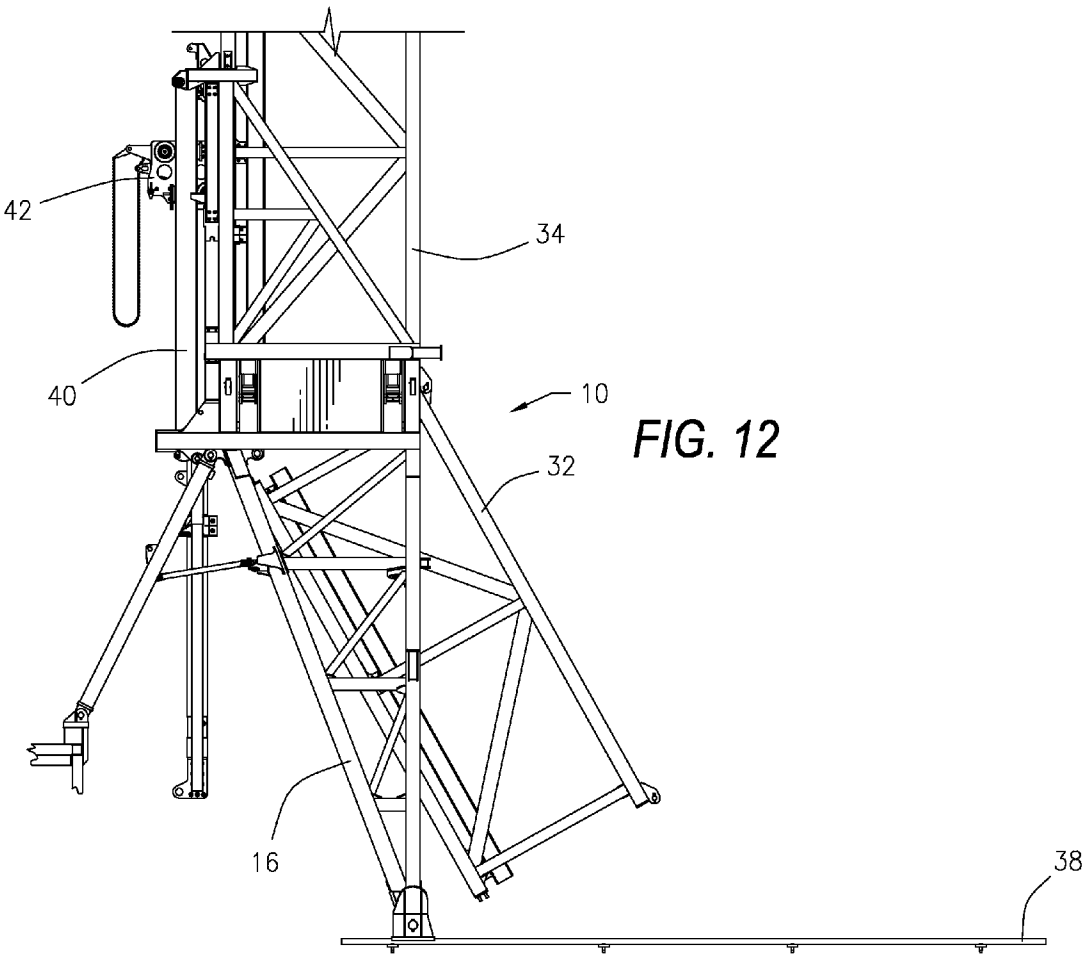
Figure 13:
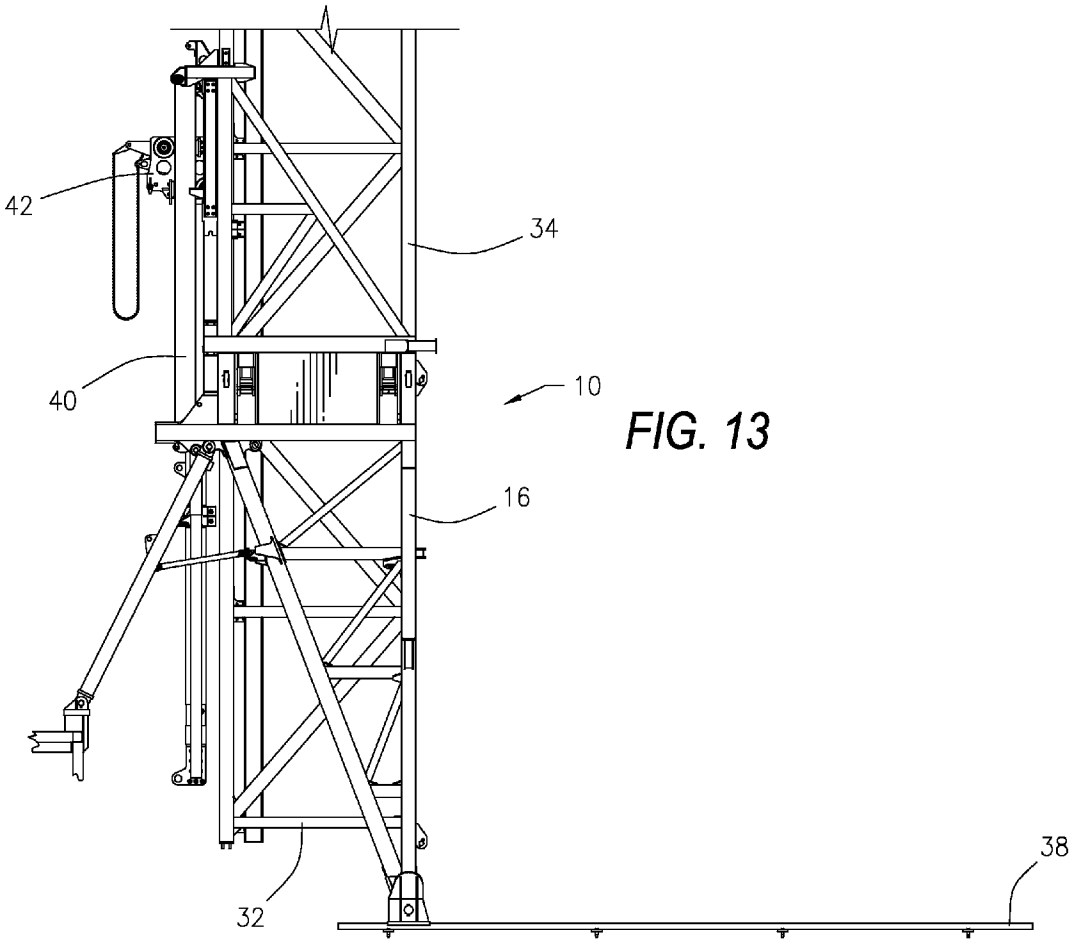

As shown in FIG. 7, the mast upper section 34 is installed within the bottom section 16 and is retained therein. The crown section 36 has already been installed. The retention pins 48 prevent the mast upper section 34 from moving downward within the bottom section 16. The mast upper mid section 32 is in a horizontal position on a platform 38 or on a ground surface (not shown) ready to be installed. The mast upper mid section 32 is pushed or dragged toward the open face of the base section 16. As seen in FIGS. 7 through 9 and in FIGS. 15 through 18, the retention pins 48 are removed. The weight of the mast upper section 34, crown section and equipment above, is supported by the ratchet support of the scoping dog assembly 42 (to be described in detail). The scoping dog assembly 42 is moved on the track 40 by action of the hydraulic cylinder 44. In the installation sequence shown in FIGS. 7 through 9, the hydraulic cylinder 44 is retracted and the mast upper section 34 is thus lowered until the base of the mast upper section 34 is adjacent to the horizontal mast upper mid section 32.

The base of the mast upper section 34 includes a pair of openings which align with a pair of openings on the top of the mast upper mid section 32. When these openings are aligned, pins or other fasteners are inserted therethrough and secured. In FIG. 9, the pins have connected the mast sections 34 and 32 together.

Thereafter, action of the scoping dog assembly 42 moving upward on the track by extension action of the hydraulic cylinder 44 causes the mast upper section 34 to move upward within the bottom section 16 which also causes the top of the mast upper mid section 32 to move upward and also rotate ninety degrees (90°) from a horizontal position to a vertical position. FIGS. 10 through 13 and FIGS. 21 through 25 illustrate this sequential action. Once the mast upper mid section 32 is fully aligned with the mast upper section 34 as in FIG. 13, the remaining pins secure the mast sections 32 and 34 together.

The pivoting ratchet supports 46 on the opposed sides 20 and 22 of the bottom section 16 may be manually rotated out of the way or, alternatively, may automatically rotate out of the way as the mast sections 32 and 34 move upward within the bottom section 16.

Figure 14:
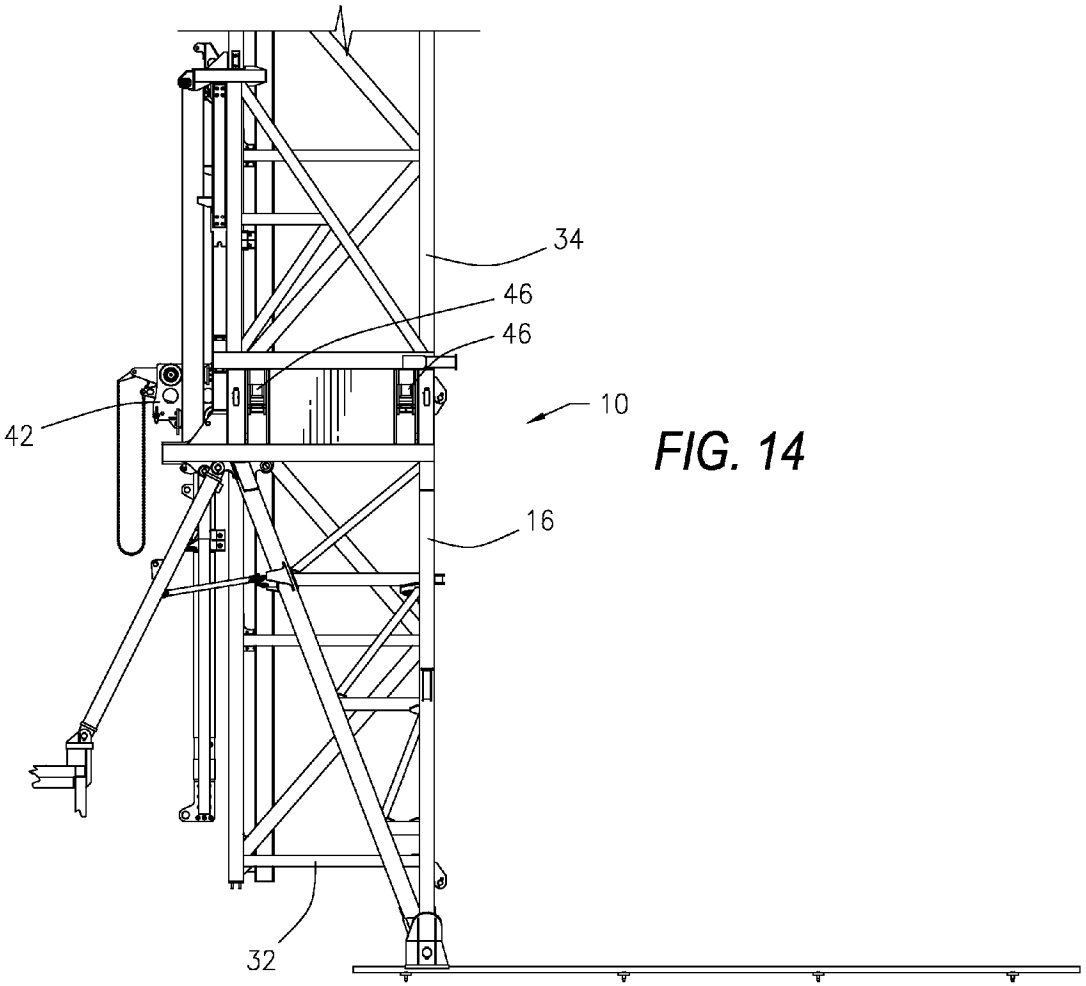

In FIG. 14, the retention pins 48 are reinstalled and the scoping dog assembly 42 has been returned to the lower position on the track.

The installation sequence continues in a similar manner for each additional mast section. For example, with the upper mid mast section 32 within and retained by the bottom section 16, the mid mast section 30 will be pushed or dragged to the open face of the base section 16. The base of the upper mid mast section 32 will be lowered until it is adjacent to the horizontal mid mast section 30. The base of the upper mid mast section 32 includes a pair of openings which will align with a pair of openings on the mid mast section 30. When these openings are aligned, pins or other fastners are inserted therethrough and secured.

Thereafter, action of the scoping dog assembly 42 moving upward by extension action of the hydraulic cylinder 44 causes the upper mid mast section 32 to move upward which also causes the top of the mid mast section 30 to move upward and rotate ninety degrees (90°) from a horizontal position to a vertical position.

Figures 15, 15A:
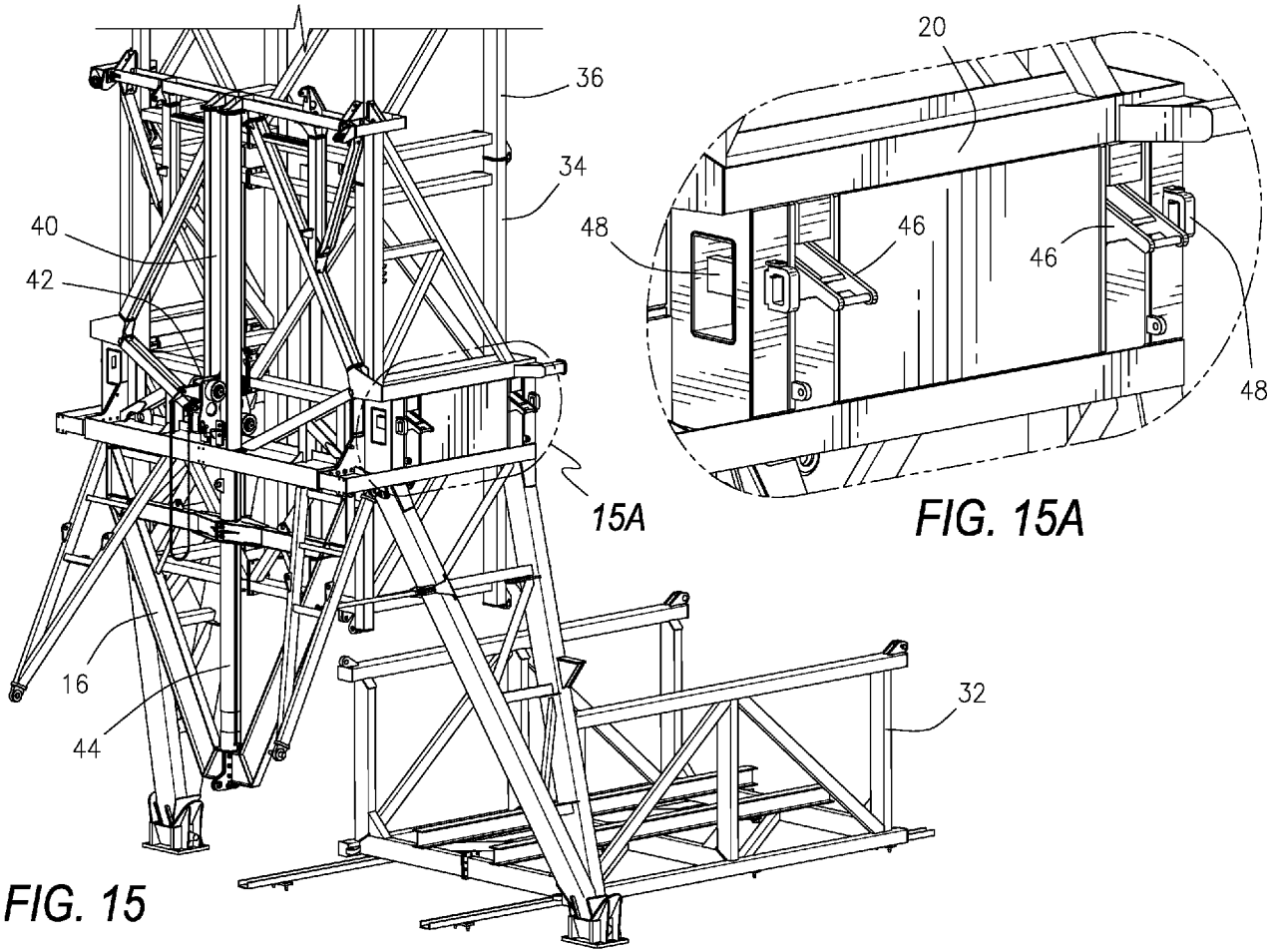
FIGS. 15 through 24 illustrate rear perspective views of the sequential installation and erection of mast sections of the sectional mast assembly of the present invention.
Figure 16:
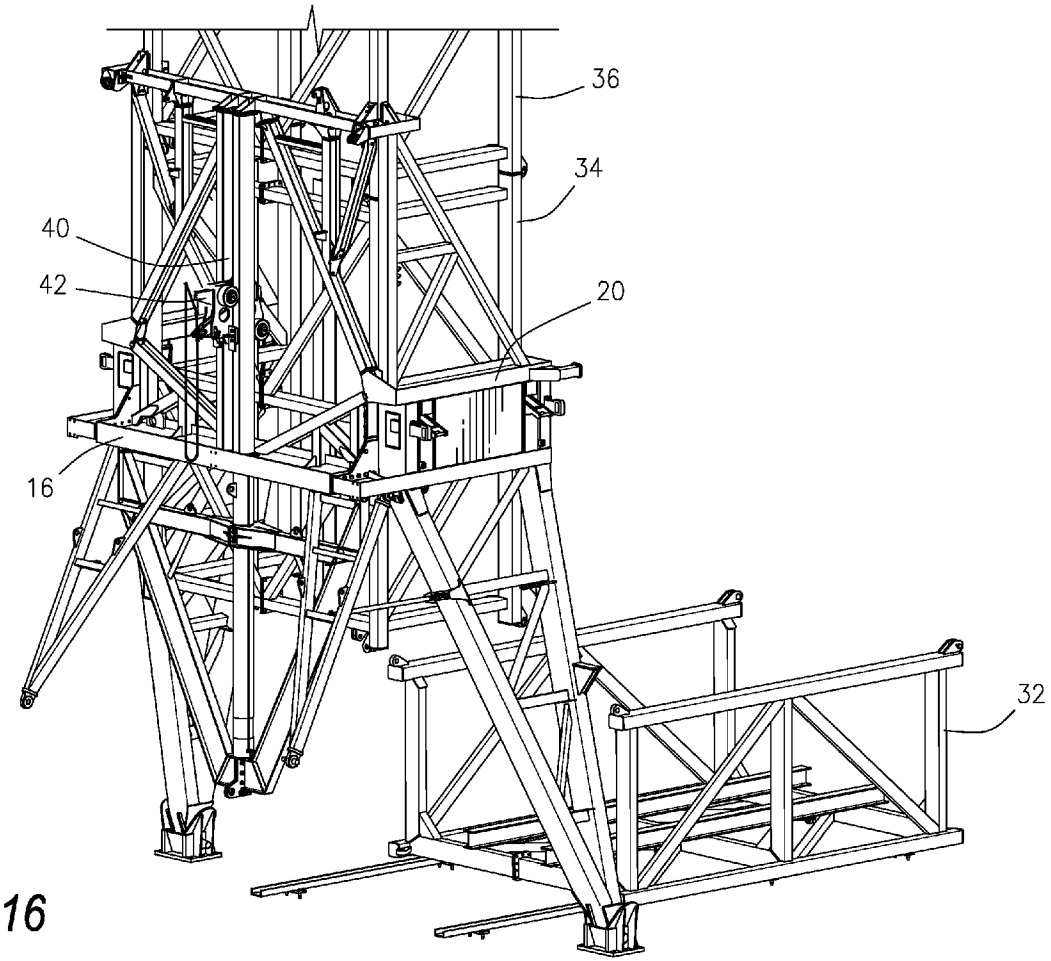
Figure 17:
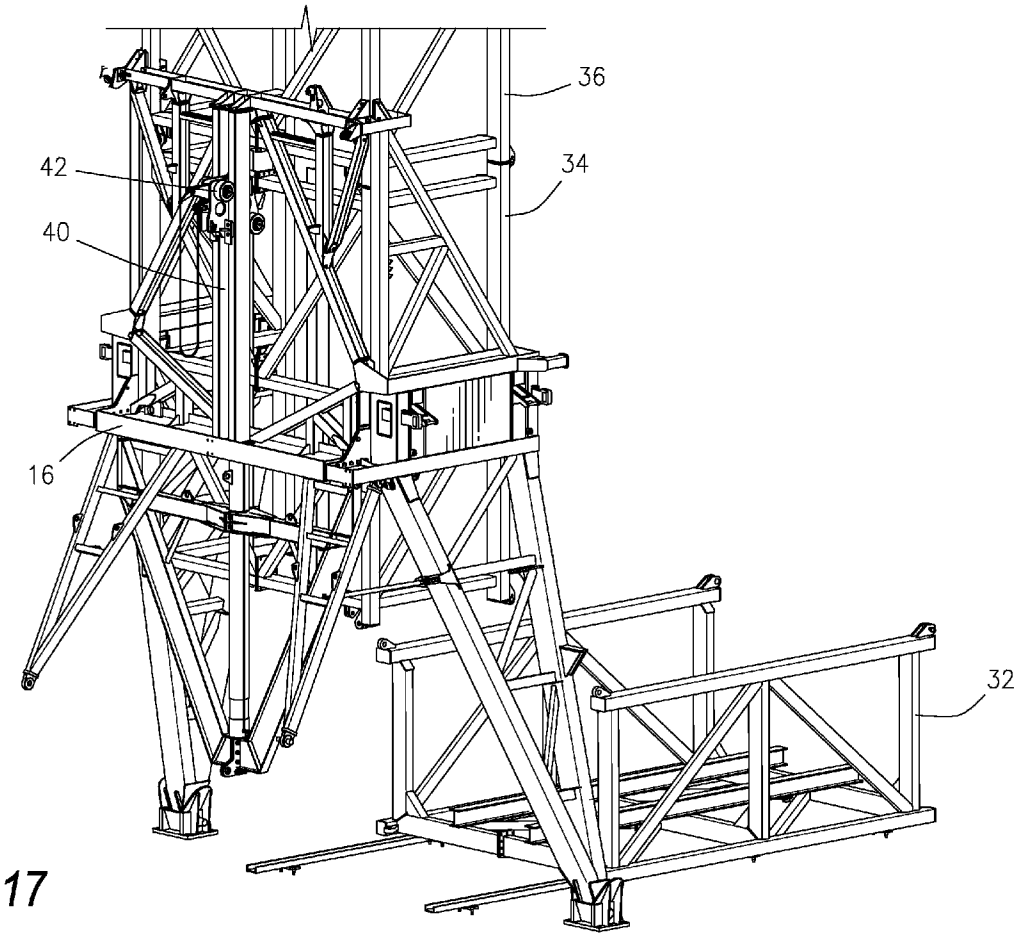
Figure 18:
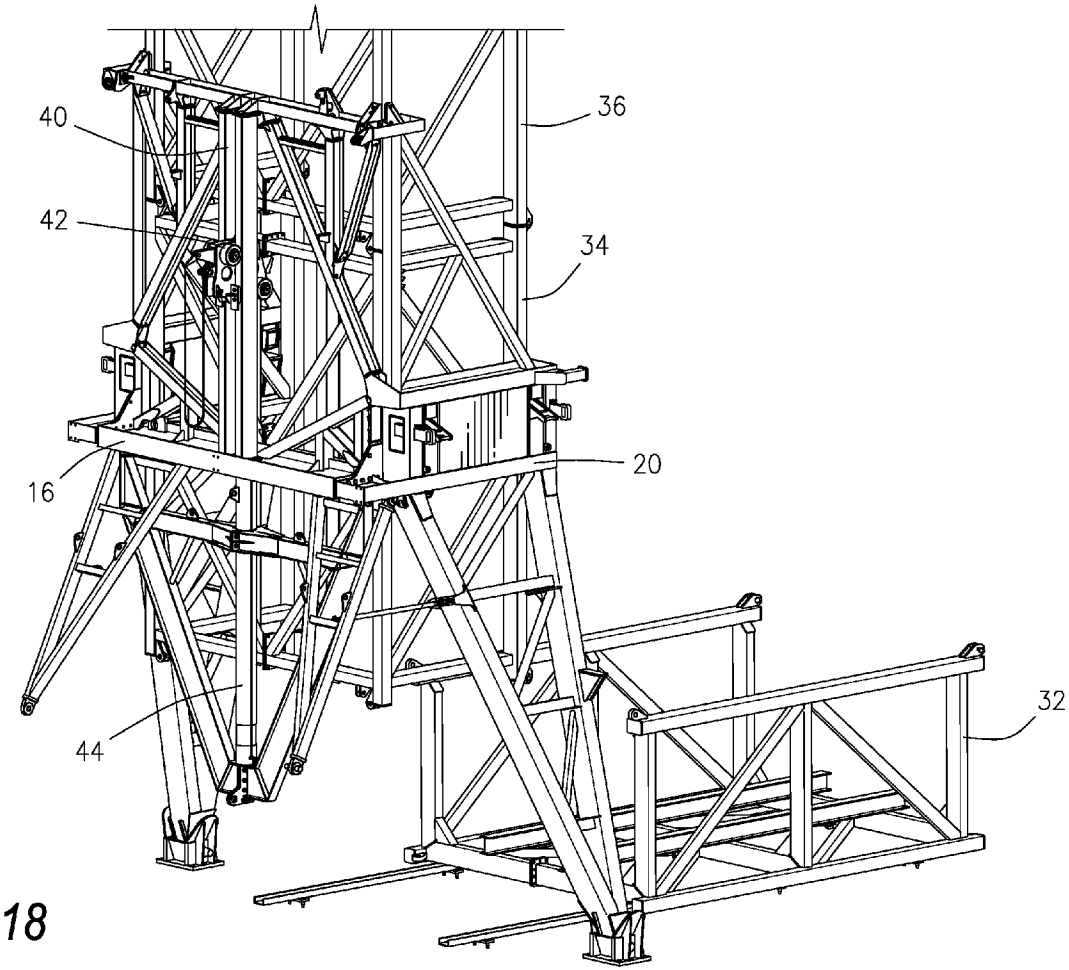
Figure 19:
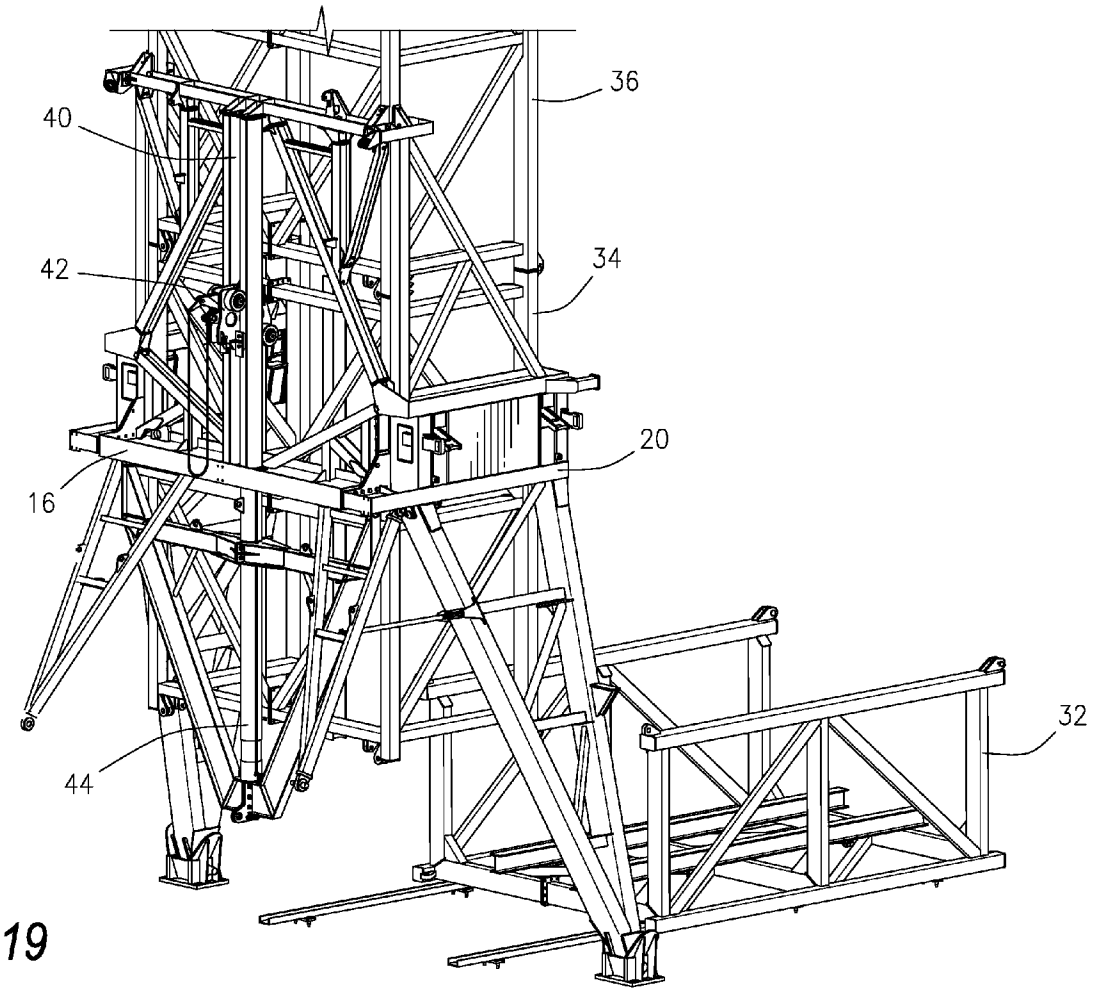
Figure 20:
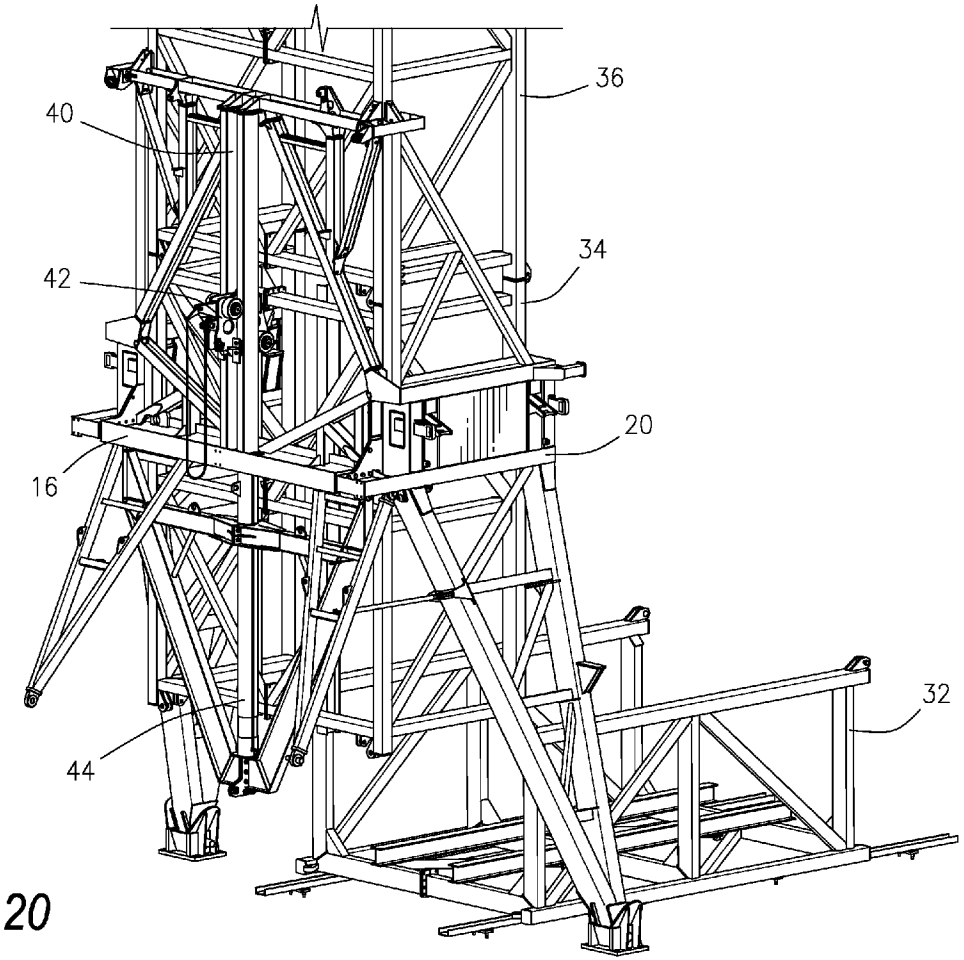
Figure 21:
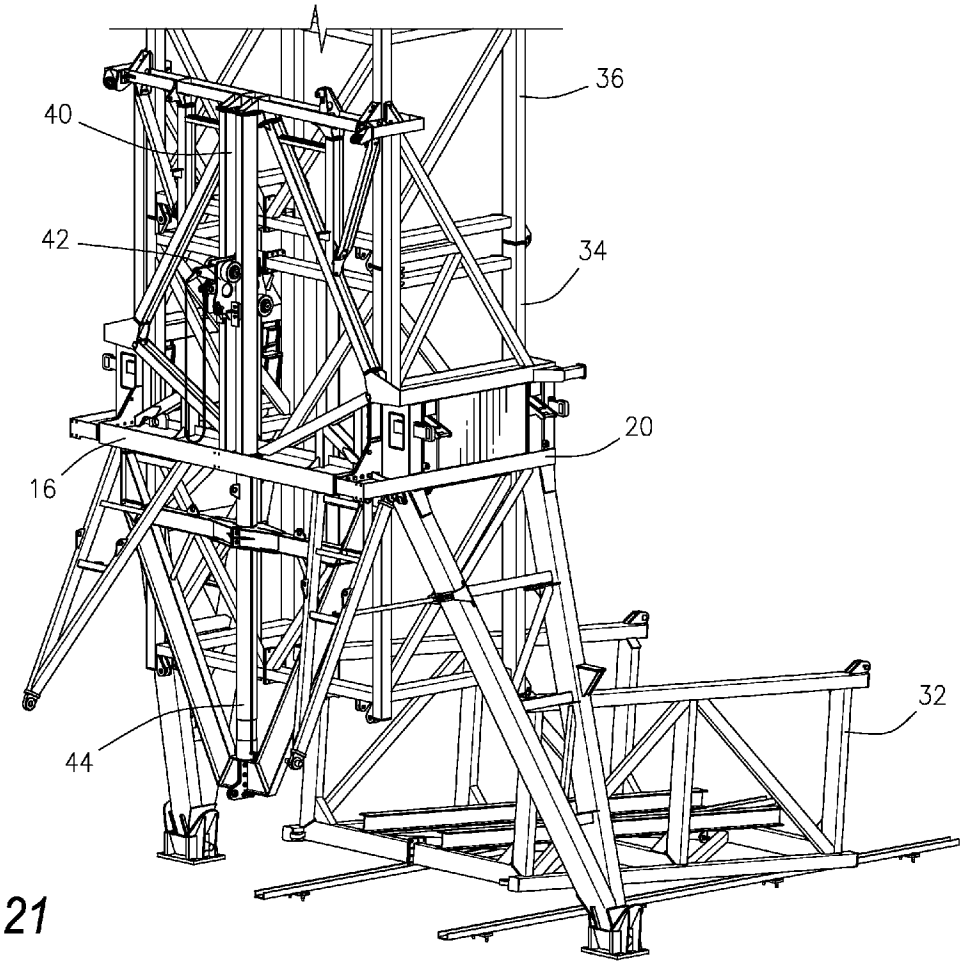
Figure 22:
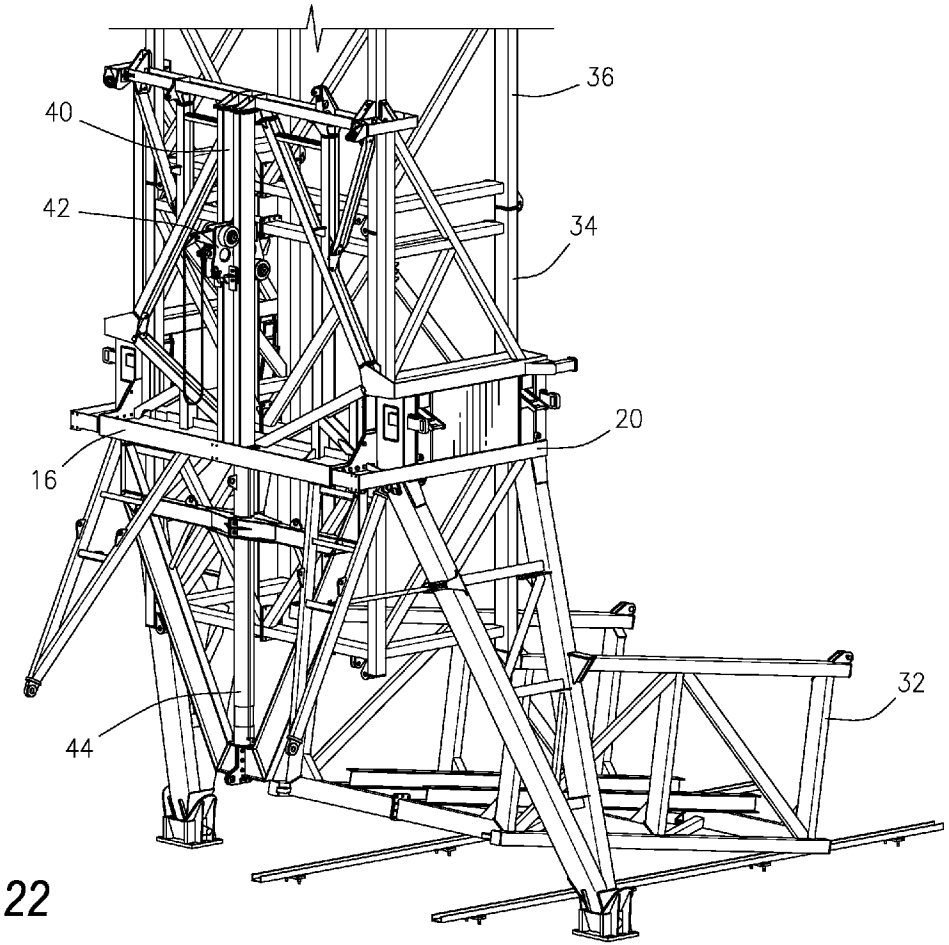
Figure 23:
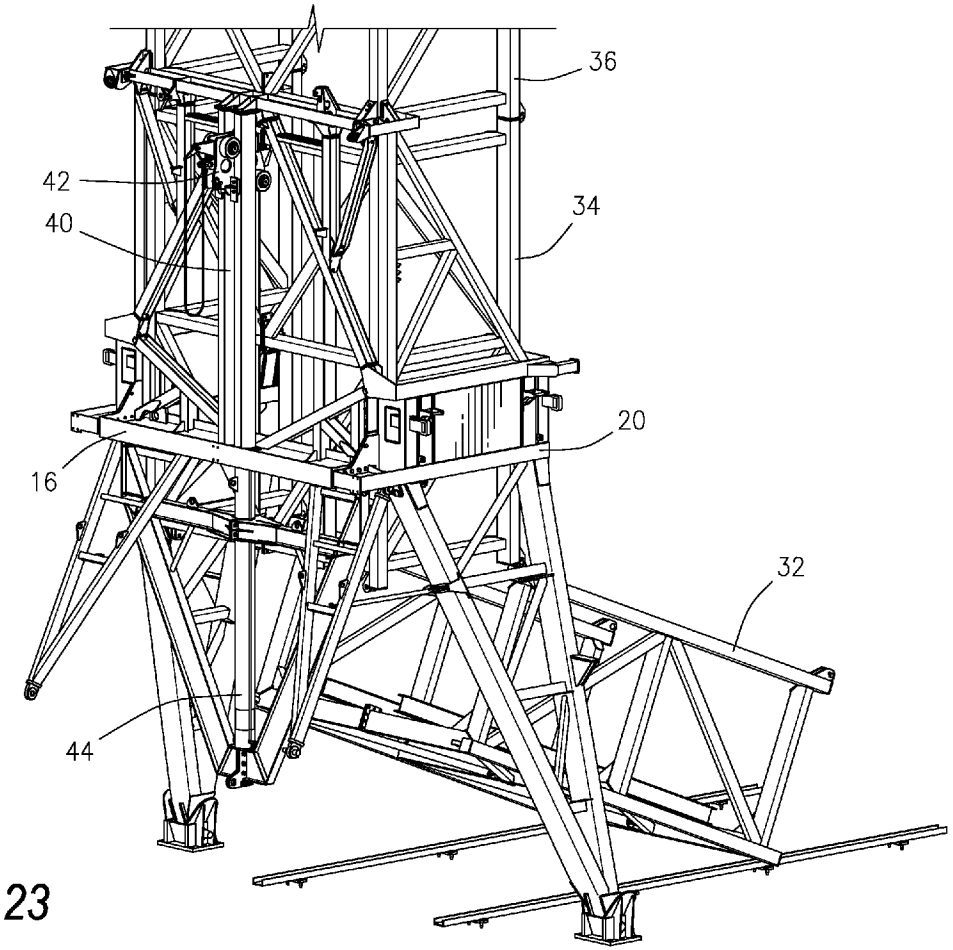
Figure 24:
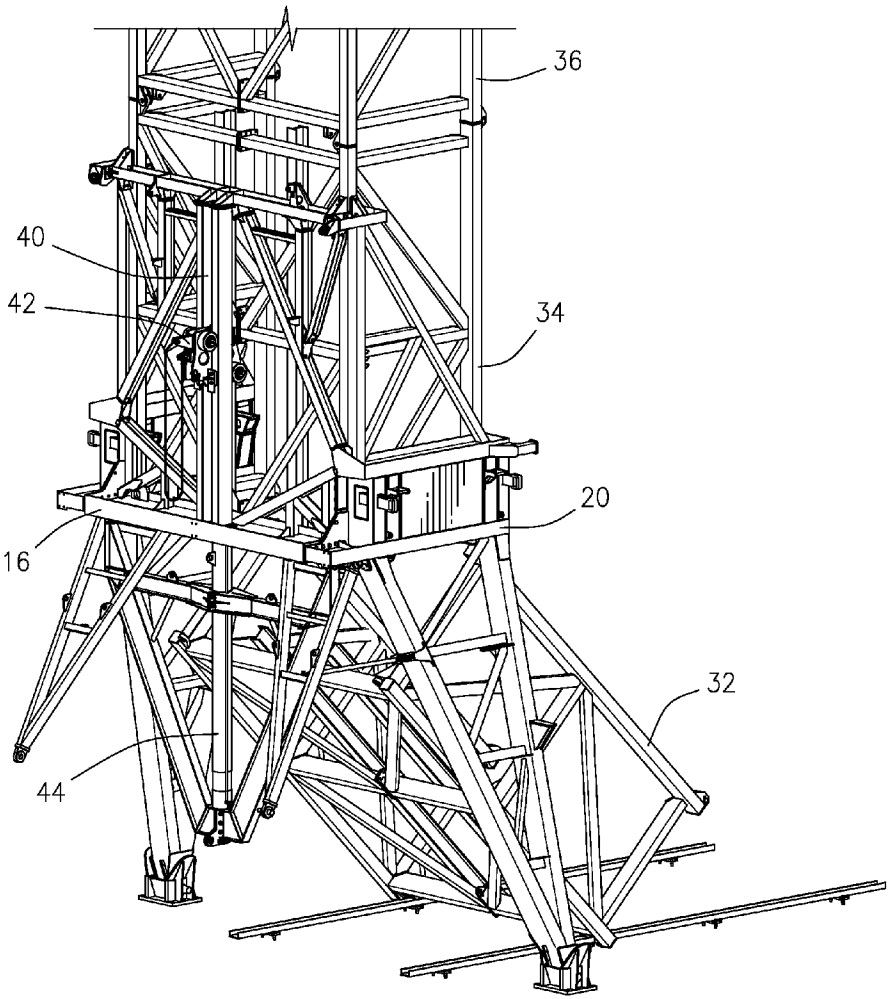
Figure 25:
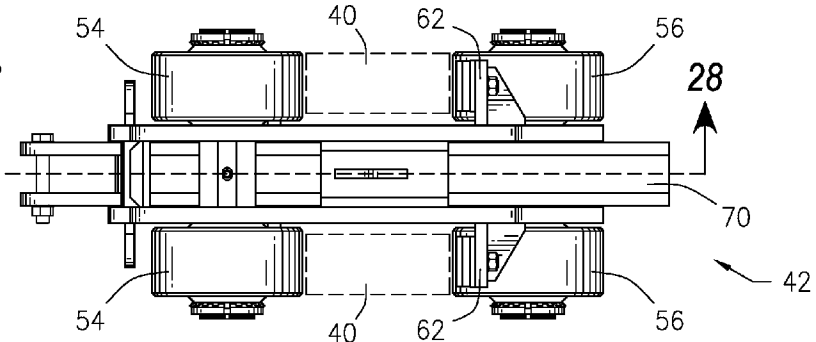
FIGS. 25 through 28 illustrate alternate views of a scoping dog assembly of the sectional mast assembly of the present invention.
Figure 27:
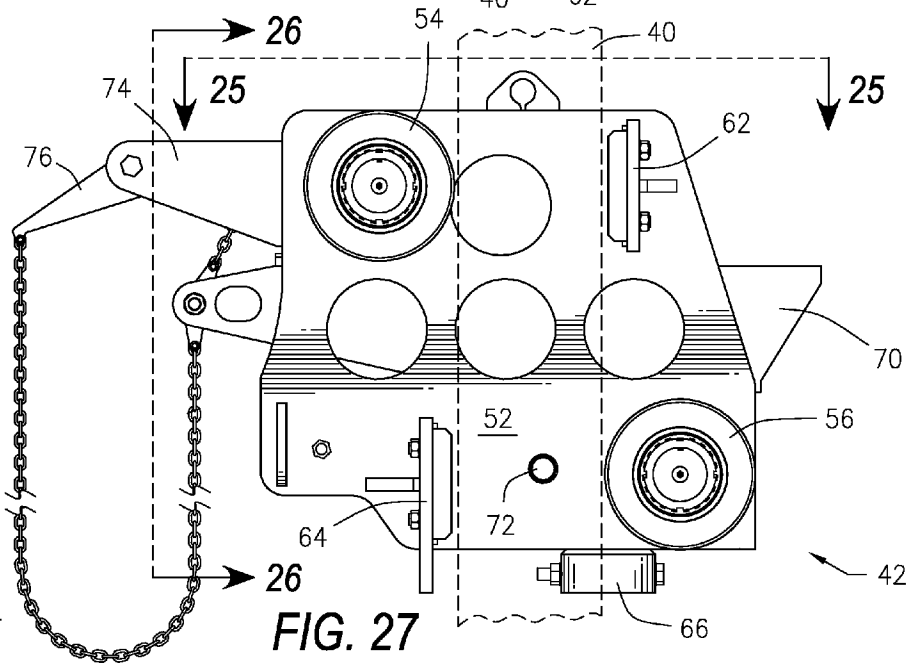
Figure 26:
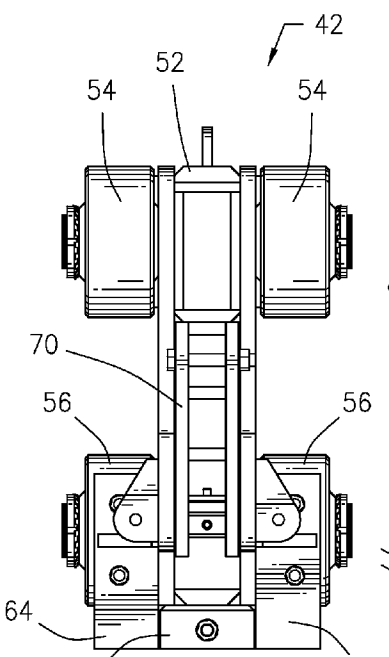
Figure 28:
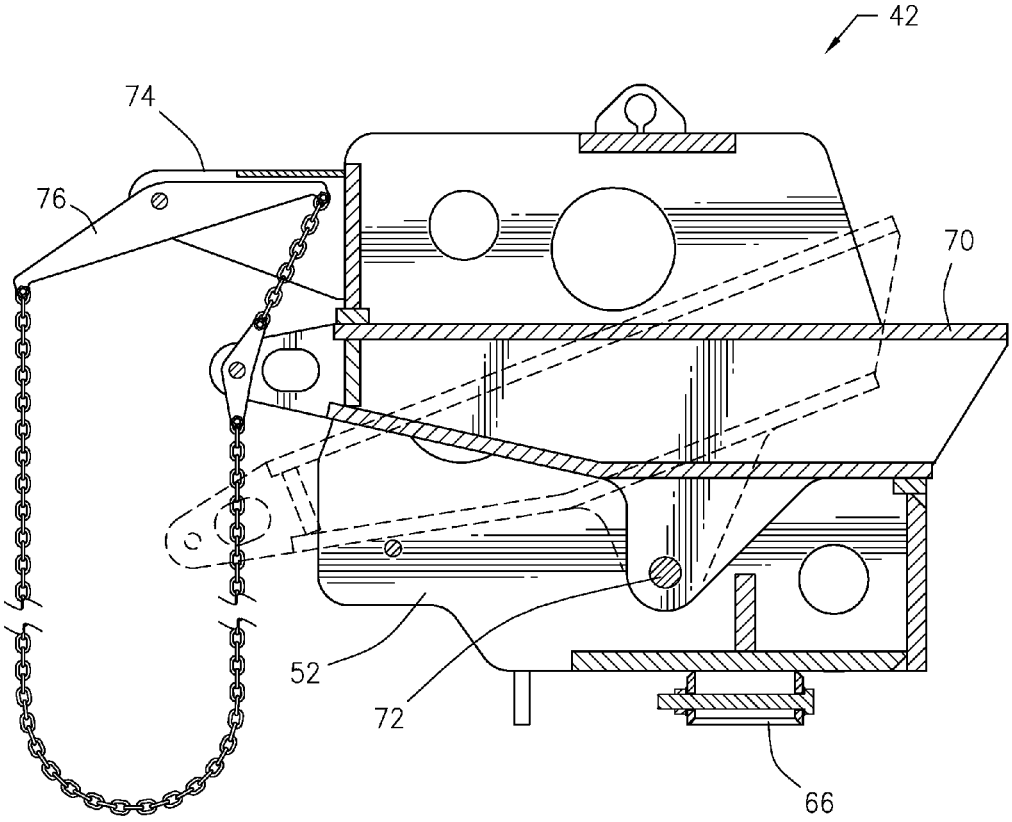

FIG. 15 illustrates a rear perspective view of the position of the sequential installation shown in FIG. 7. The view shown by FIG. 15A illustrates an enlarged portion of the side 20 of the bottom section 16 wherein the ratchet assembly 46 and the retention pins 48 are visible.

Additional mast sections 30, 28, and 26 would be installed and raised in a similar sequential manner.

In order to disassemble the sectional mast assembly 10, the opposite procedure is performed. The retention pins will be removed so the lower most mast section is retained by the scoping dog assembly. During transportation and storage, the crown section may be stored in the bottom section.

FIGS. 25, 26, 27 and 28 illustrate the scoping dog assembly 42 in detail apart from the bottom section 16. The scoping dog assembly 42 includes a central body 52. The scoping dog assembly 42 also includes a pair of wheels or rollers 54 on one side of the track 40 and another pair of wheels or rollers 56 on the opposite side of the track 40 (shown in dashed lines in FIGS. 25 and 27). Bearings and seals are interposed between the wheels or rollers and the central body 52.

Spaced from and opposed to the wheels 54 are a pair of guide pads 62. Spaced from and opposed to the wheels 56 are a pair of guide pads 64.

The central body 52 of the scoping dog assembly will be connected to the hydraulic cylinder 44 (not shown) at a connector 66.

A pivoting ratchet support 70 pivots on the central body 52 around an axis pin 72. When in the normal rest position, the ratchet support 70 extends in the open interior of the bottom section. The ratchet support 70 will, thus, support any mast section within the bottom section 16.

An ear 74 extends from the central body 50 to support a pivot arm 76. One end of the pivot arm 76 is connected to the outside of the ratchet support 70 by a chain. Another end of the pivot arm 76 is connected to another chain so that the ratchet support 70 may be moved by movement of the chain.

Whereas, the present invention has been described in relation to the drawings attached hereto, it should be understood that other and further modifications, apart from those shown or suggested herein, may be made within the spirit and scope of this invention.

What is claimed is:

1. A method of erecting a mast assembly of a rig, which method comprises:

engaging a first mast section within a bottom section with a pivoting ratchet support of a scoping dog assembly;

attaching a top of a second mast section in a generally horizontal position to a base of said first mast section;

raising said mast sections by moving said scoping dog assembly on said track on a bottom section, wherein said scoping dog assembly has a pair of wheels on one side of said track and a pair of wheels on another side of said track;

supporting said mast sections on pivoting ratchet supports on said bottom section; and repeating said steps for additional mast sections such that the first mast section is above the second mast section and the second mast section is above said additional mast sections when the mast assembly is fully erected.

2. A method of erecting a mast assembly of a rig as set forth in claim 1 wherein said scoping dog assembly is moved on said track by an extension and retraction mechanism between said bottom section and said scoping dog assembly.

3. A method of erecting a mast assembly of a rig as set forth in claim 2 wherein said extension and retraction mechanism is a telescoping hydraulic cylinder.

4. A method of erecting a mast assembly of a rig as set forth in claim 1 wherein said mast section are raised by moving within channel guides on said bottom section.

5. A method of erecting a mast assembly of a rig as set forth in claim 1 wherein said second mast section in a horizontal position is attached to said first mast section by pins.

* * * * *